US006019633A

United States Patent [19]

Tung et al.

[11] Patent Number: 6,019,633

[45] Date of Patent: Feb. 1, 2000

[54] ELECTRONIC CARD CONNECTOR

[75] Inventors: Shun-Chi Tung, Tu-Chen; Hung-Chi Yu, Hsi-Chih, both of Taiwan

[73] Assignee: Hon Hai Precision Ind. Co., Ltd., Taipei Hsien, Taiwan

[21] Appl. No.: 09/324,610

[22] Filed: Jun. 2, 1999

[30] Foreign Application Priority Data

Sep. 25, 1998 [TW] Taiwan ..... 87215981

[51] Int. Cl.[7] ..... H01R 13/73

[52] U.S. Cl. ..... 439/570; 439/573

[58] Field of Search ..... 439/569–573

[56] References Cited

U.S. PATENT DOCUMENTS 5,249,983 10/1993 Hirai ..... 439/573
5,688,143 11/1997 McHugh et al. ..... 439/570
5,879,187 3/1999 Cheng et al. ..... 439/570

*Primary Examiner*—Gary F. Paumen

*Attorney, Agent, or Firm*—Wei Te Chung

[57] ABSTRACT

An electronic card connector adapted to be mounted to a circuit board for receiving and electrically connecting an electronic card to the circuit board, includes two insulative headers each having a plurality of contact terminals retained therein. Free ends of the contact terminals extend out of the headers and are soldered to an adapter board. The adapter board has rows of contact points formed thereon and staggered with respect to each other. The contact points of the adapter board may define holes through which the free ends of the contact terminals extend. Alternatively, the free ends of the contact terminals may be surface mounted to the contact points. A stand-off member has a bottom mounted to the circuit board and an upright stem extending from the bottom. A sideways projection extending from the stem is interferentially fit into a corresponding receptacle hole defined in the headers for supporting the connector on the circuit board. A leg attached to the connector and spaced from the stand-off member is selectively provided for more securely supporting the connector on the circuit board.

6 Claims, 6 Drawing Sheets

ELECTRONIC CARD CONNECTOR

BACKGROUND OF THE INVENTION

1. Field of the Invention

The present invention generally relates to an electronic card connector, and in particular to an electronic card connector having a stand-off device and an adapter board for connecting the connector to a circuit board.

2. The Prior Art

As computer technology advances, the dimension of a computer is becoming increasingly smaller while the functional performance thereof is improving. The computer is often equipped with an electronic card connector for releasably connecting an electronic card, such as a memory card, for expanding the functional capabilities of the computer. Examples of conventional electronic card connectors are disclosed in Taiwan patent application Nos. 83218076 and 85219426.

FIG. 1A of the attached drawings shows a conventional electronic card connector wherein two connectors 156, 157 are stacked on each other and supported on a circuit board 151. Stand-off members 162 are provided between the connectors 156, 157 and the circuit board 151 for spacing the connectors 156, 157 a predetermined distance from the circuit board 151. The upper connector 156 has contact terminals 158 soldered to an adapter board 154 that is connected to the circuit board 151 by means of a card edge connector 153. Similarly, the lower connector 157 has contact terminals 159 soldered to another adapter board 155 that is connected to the circuit board 151 by means of a card edge connector 152.

Such an arrangement, however, presents several disadvantages. For example, each adapter board 154, 155 has two rows of terminal receiving holes that are generally aligned with each other as shown in FIG. 1B. Such an arrangement causes traces 166 of the upper row terminal receiving holes to extend in a non-straight path in order to avoid overlapping the lower row terminal receiving holes. The greater the number of terminal receiving holes defined in the adapter board, the more complicated the layout of the traces becomes. Furthermore, such an arrangement requires the upper and lower connectors to have individual adapter boards. Thus, manufacture of the electronic card connector is complicated and the overall dimension of the electronic card connector is increased.

Furthermore, the sole function of the stand-off members 162 of the conventional electronic card connector is to space the connectors 156, 157 from the circuit board 151. Additional fasteners are needed to secure the connectors 156, 157 to the circuit board.

It is thus desirable to have an electronic card connector that overcomes the above discussed problems of the prior art.

SUMMARY OF THE INVENTION

Accordingly, an object of the present invention is to provide an electronic card connector comprising two connector units connected to a common adapter board for electrically connecting the two connector units to a circuit board.

Another object of the present invention is to provide an electronic card connector comprising two connector units connected to a substrate circuit board by means of a single adapter board thereby simplifying the manufacture of the electronic card connector and reducing the overall dimension thereof.

A further object of the present invention is to provide an electronic card connector comprising stand-off devices each having a bottom mounted to a circuit board and a sideways projection interferentially fit into a corresponding hole defined in the connector thereby securely supporting the connector on the circuit board.

To achieve the above objects, an electronic card connector in accordance with the present invention adapted to be mounted to a circuit board for receiving and electrically connecting an electronic card to the circuit board, comprises two insulative headers each having a plurality of contact terminals retained therein. Free ends of the contact terminals extend out of the headers and are soldered to an adapter board. The adapter board has rows of contact points formed thereon and staggered with respect to each other. The contact points of the adapter board may define holes through which the free ends of the contact terminals extend. Alternatively, the free ends of the contact terminals may be surface mounted to the contact points. A stand-off member has a bottom mounted to the circuit board and an upright stem extending from the bottom. A sideways projection extending from the stem is interferentially fit into a corresponding receptacle hole defined in the headers for supporting the connector on the circuit board. A leg attached to the connector and spaced from the stand-off member is selectively provided for more securely supporting the connector on the circuit board.

BRIEF DESCRIPTION OF THE DRAWINGS

The present invention will be apparent to those skilled in the art by reading the following description of the preferred embodiments thereof, with reference to the accompanying drawings, in which.

DETAILED DESCRIPTION OF THE PREFERRED EMBODIMENTS

Figure 1A:
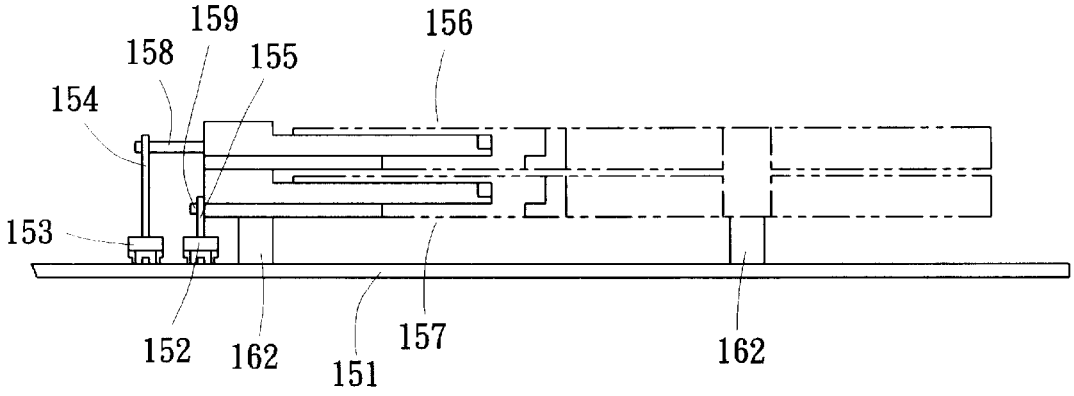
FIG. 1A PRIOR ART
FIG. 1A is a side elevational view of a conventional electronic card connector.
Figure 1B:
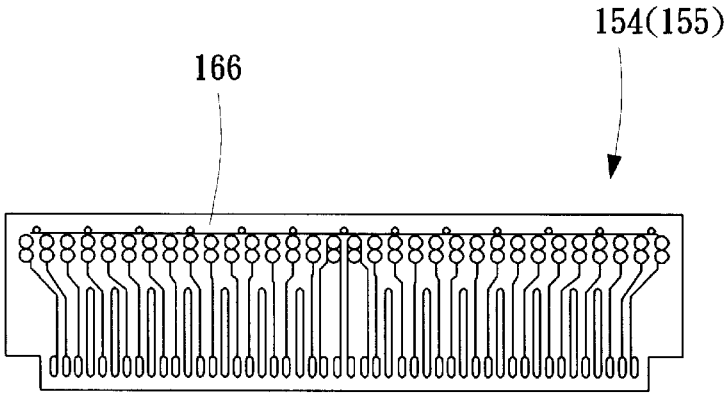
FIG. 1B PRIOR ART
FIG. 1B is a plan view of an adapter board of the conventional electronic connector.
Figure 2:
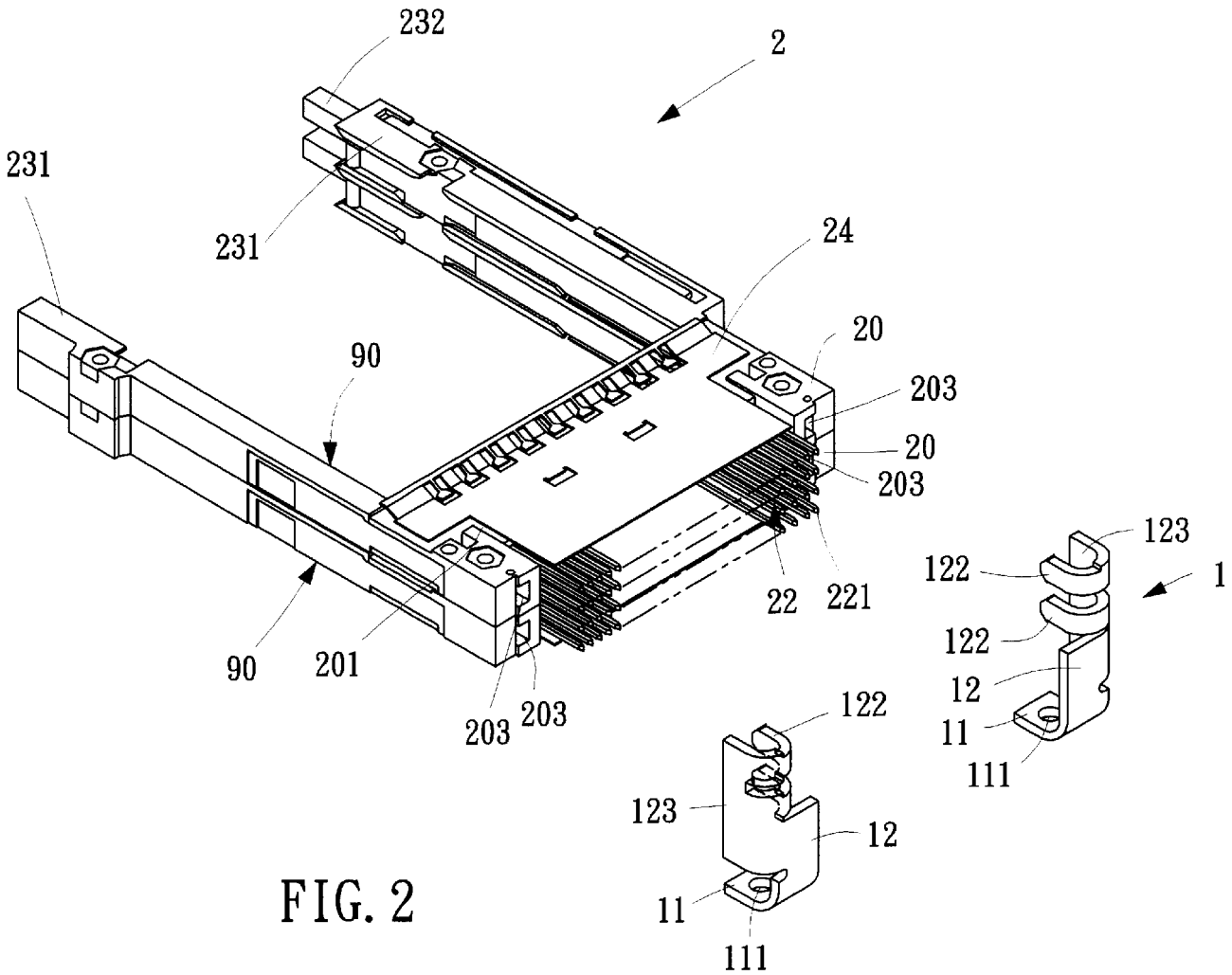
FIG. 2 is an exploded view of an electronic card connector constructed in accordance with the present invention.

Referring to the drawings and in particular to FIG. 2, wherein an electronic card connector constructed in accordance with a first embodiment of the present invention, generally designated by reference numeral 2, is shown, the electronic card connector 2 has a dual-unit configuration, comprising two connector units 90 stacked on each other. Each connector unit 90 has a header 20 having a U-shaped configuration, comprising a central terminal receiving section 201 defining a plurality of terminal receiving channels 202 therein for receiving and retaining two rows of contact terminals 22 and two side limbs 231 each defining guide slots for guiding an electronic card (not shown) into the connector 2. A card release bar 232 is movably mounted to one of the side limbs 231 for driving a card release mechanism (not shown) to release the electronic card from a corresponding connector unit 90 of the connector 2.

The headers 20 of the two connector units 90 each define a pair of receptacle holes 203 therein proximate opposite lateral sides thereof The receptacle holes 203 of the connector units 90 are substantially aligned with each other.

Figure 5:
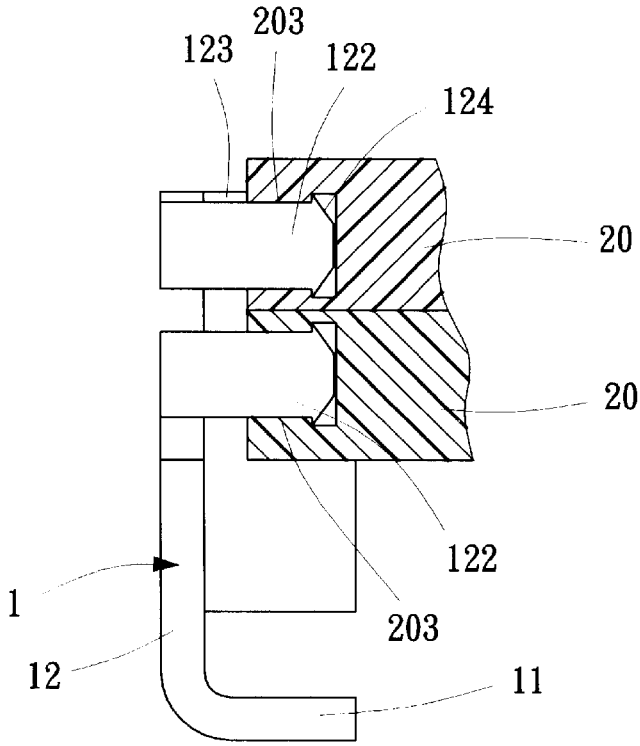
FIG. 5 is an enlarged cross-sectional view of a portion of the electronic card connector of the present invention.

Also referring to FIG. 5, a stand-off member 1 comprises a bottom 11 adapted to be fixed to a substrate (not shown) and an upright stem 12 extending from the bottom 11. Two sideways projections 122 extend from the stem 12 corresponding to the receptacle holes 203 of the headers 20. The projections 122 are received in the corresponding receptacle holes 203 for supporting the connector 2. Preferably, each sideways projection 122 forms barbs 124 on opposite edges of free ends thereof. The barbs 124 are interferentially fit into the corresponding receptacle hole 203. The stand-off member 1 comprises an extension 123 opposite to and spaced from the projections 122 to define a U-shaped configuration. The extension 123 is fit over lateral ends of the headers 20 for securely attaching the stand-off member 1 to the headers 20. If desired, the bottom 11 of the stand-off member 1 may define a hole 111 therein for receiving a bolt (not shown) for securing the stand-off member 1 to the substrate.

A grounding plate 24 is attached to the connector 2 for shielding the contact terminals 22. Each contact terminal 22 has a free end 221 extending out of the header 20 for electrically connecting to the substrate.

Figure 3:
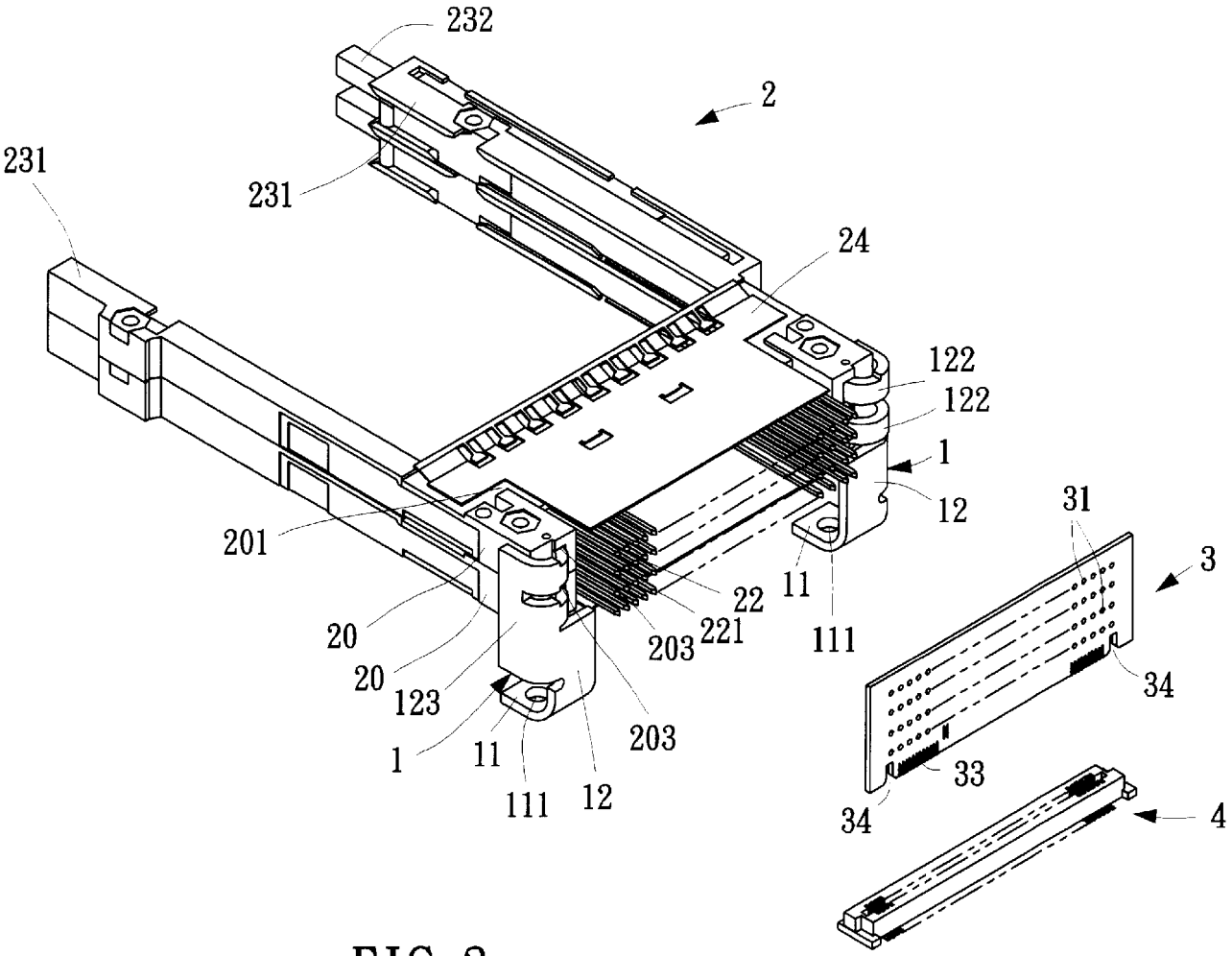
FIG. 3 is an assembled view of FIG. 2 also showing an adapter board and a card edge connector.
Figure 4:
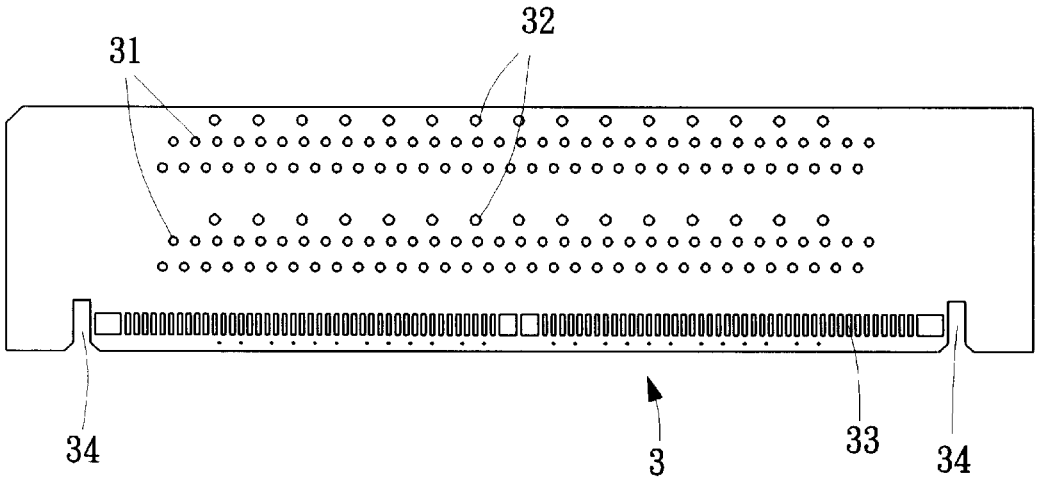
FIG. 4 is a plan view of the adapter board.

Referring to FIG. 3, an adapter board 3 defines four rows of holes 31 therein for receiving the rows of contact terminals 22 of the connector units 90. Two of the four rows are associated with the upper connector unit 90 and the remaining two rows are associated with the lower connector unit 90. As shown in FIG. 4, the two rows of holes 31 associated with each of the connector units 90 are arranged to be staggered with respect to each other thereby simplifying the layout of conductive traces extending from the holes 31 to external contacts 33 formed on an edge of the adapter board 3. In other words, staggered arrangement of the holes in the adapter board 3 may form two groups of the staggered holes in a single board 3 to respectively receive the contact tail tips of both the upper and lower connector units 90, thus simplifying the fabrication procedure. It can be understood that because the holes 31 in the adapter board 3 are arranged to be staggered with each other, the contact tail tips of the associated connector unit 90 should be in the same staggered format accordingly. Moreover, the adapter board 3 also defines two rows of grounding holes 32 corresponding to the two connector units 90.

The adapter board 3 is inserted into a card edge connector 4 mounted on the substrate for electrically connecting the electronic card connector 2 thereto. Notches 34 are defined in an edge of the adapter board 3 for more securely retaining the adapter board 3 in the card edge connector 4.

In the embodiment illustrated above, free ends 221 of the contact terminals 22 are received in the holes 31 defined in the adapter board 3. The contact terminals 22 may also be surface mounted to the adapter board 3.

Figure 6:
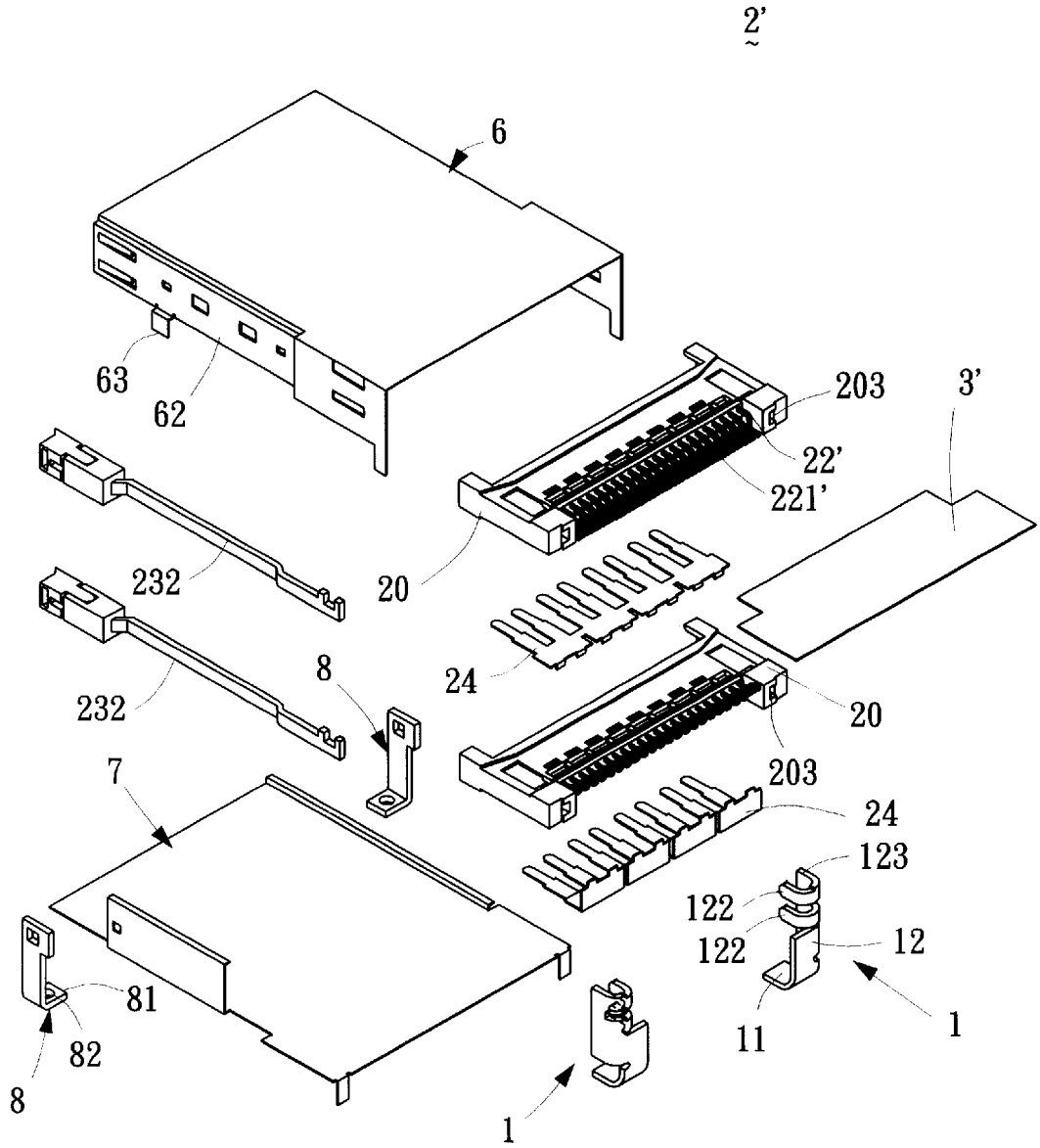
FIG. 6 is an exploded view of an electronic card connector in accordance with a second embodiment of the present invention.
Figure 7:
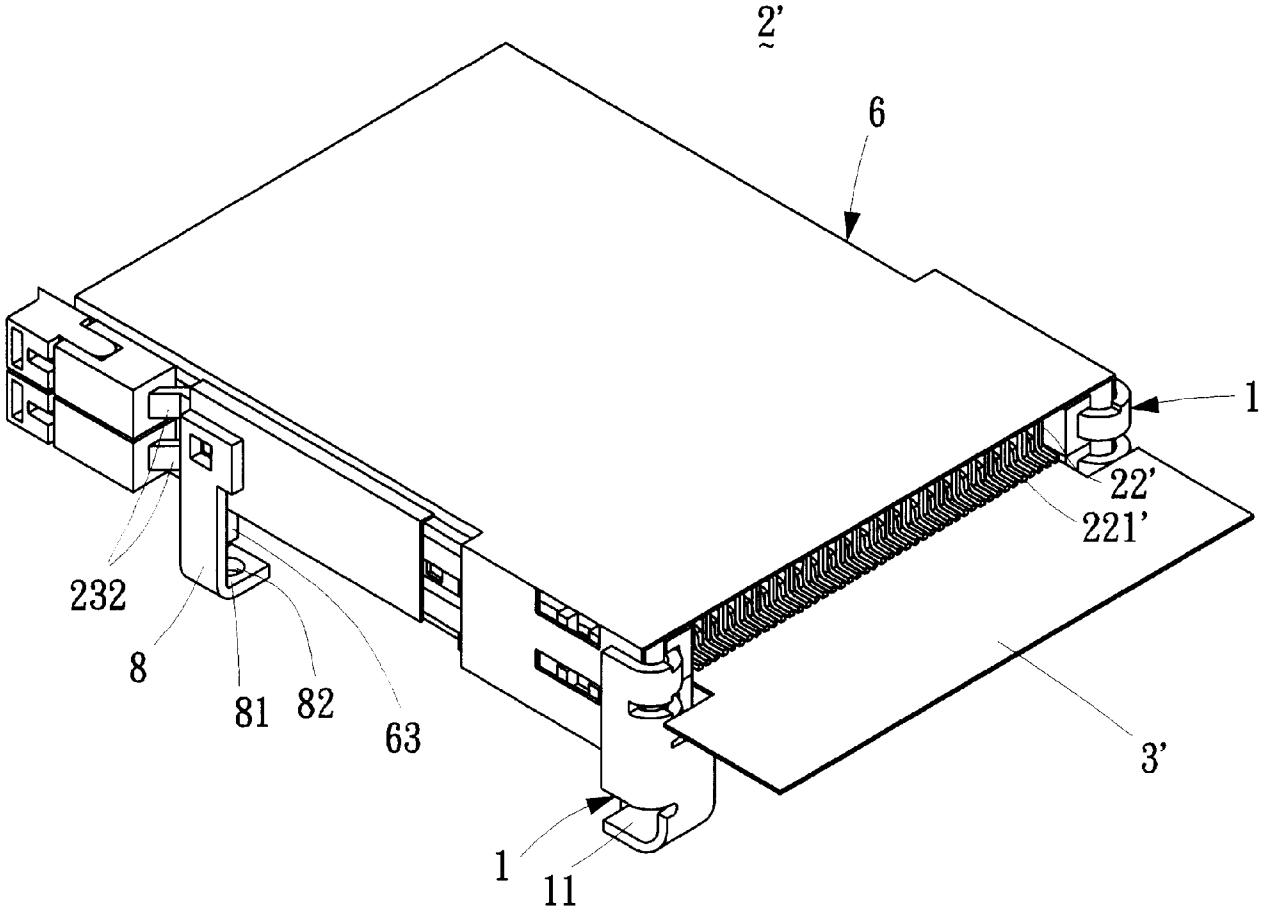
FIG. 7 is an assembled view of FIG. 6.

Referring to FIGS. 6 and 7, an electronic card connector in accordance with a second embodiment of the present invention is designated by reference numeral 2' and comprises two headers 20 stacked on each other. Each header 20 has a plurality of contact terminals 22' received and retained therein in a row. The contact terminals 22' have free ends 221' which are offset from a main portion of the contact terminals 22' and extend out of the header 20. Each row of the free ends 221' are arranged to be proximate each other for receiving an adapter board 3' therebetween. The free ends 221' of the contact terminals 22' can then be surface mounted to the adapter board 3'. Each header 20 comprises a grounding plate 24 for grounding purposes.

Each header 20 defines a pair of receptacle holes 203 therein for receiving the sideways projection 122 of the corresponding stand-off member 1 thereby supporting the connector 2' on the substrate.

The connector 2' has a casing comprising an upper casing member 6 and a lower casing member 7. The upper casing member 6 has two side walls 62 on which the card release bars 232 of the headers 20 are movably mounted.

The side walls 62 of the upper casing member 6 comprise a supporting member 63 to which a leg 8 is attached. The leg 8 has a bottom 81 positioned on the substrate thereby more securely supporting the connector 2' on the substrate. If desired, the bottom 81 of the leg 8 may define a hole 82 therein for receiving a bolt (not shown) for securing the leg 8 to the substrate.

Although the present invention has been described with reference to preferred embodiments thereof, it is apparent to those skilled in the art that a variety of modifications and changes that may be made without departing from the scope of the present invention which is intended to be defined by the appended claims.

What is claimed is:

1. An electronic card connector comprising two connector units each adapted to be mounted to a substrate for receiving and electrically connecting an electronic card to the substrate by means of stand-off members, each connector unit of the electronic card connector comprising an insulative header having two receptacle holes defined therein, each stand-off member comprising a bottom positioned on the substrate and an upright stem extending from the bottom, two sideways projection extending from the stem and interferentially fit into the corresponding receptacle hole of the headers of the connector units for supporting the connector on the substrate.

2. The electronic card connector as claimed in claim 1, wherein each sideways projection of the stand-off member has barbs formed on opposite edges of free ends thereof for interferentially fitting into the corresponding receptacle hole.

3. The electronic card connector as claimed in claim 1, wherein the receptacle holes are respectively located proximate opposite lateral ends of the header and wherein the stand-off member further comprises an extension spaced from and opposite to the sideways projection for fitting over the corresponding lateral end of the header.

4. The electronic card connector as claimed in claim 1, wherein the bottom of the stand-off member defines a hole therein adapted to receive a bolt for securing the stand-off member to the substrate.

5. The electronic card connector as claimed in claim 1 further comprising a leg corresponding to and spaced from the stand-off member, the leg being positioned on the substrate and attached to the connector for securely supporting the connector on the substrate.

6. The electronic card connector as claimed in claim 5, wherein the leg comprises a bottom positioned on the substrate, the bottom defining a hole therein adapted to receive a bolt for securing the leg to the substrate.

* * * * *